United States Patent [19]

Brand et al.

[11] 4,284,088

[45] Aug. 18, 1981

[54] METHOD OF MONITORING FILTER ROD SECTIONS IN FILTER TIPPING MACHINES

[75] Inventors: Peter Brand, Hamburg; Peter Pinck, Gross-Hansdorf; Anton Baier, Wentorf, all of Fed. Rep. of Germany

[73] Assignee: Hauni-Werke Körber & Co. KG, Hamburg, Fed. Rep. of Germany

[21] Appl. No.: 168,187

[22] Filed: Jul. 10, 1980

Related U.S. Application Data

[62] Division of Ser. No. 945,696, Sep. 25, 1978, Pat. No. 4,238,999.

[30] Foreign Application Priority Data

Sep. 23, 1977 [DE] Fed. Rep. of Germany ..... 2742856

[51] Int. Cl.[3] ..... A24C 5/47; A24C 5/52; A24C 5/58; A24C 5/60

[52] U.S. Cl. ..... 131/280; 131/76; 131/88

[58] Field of Search ..... 131/20 R, 21 R, 21 C, 131/21 B, 88, 90, 91, 93, 94, 95, 76; 93/1 C, 77 FT

[56] References Cited

U.S. PATENT DOCUMENTS

| | | | |
|---|---|---|---|
| 3,212,507 | 10/1965 | Schubert | 131/21 R |
| 3,699,974 | 10/1972 | Powell et al. | 131/21 R |

*Primary Examiner*—Vincent Millin
*Attorney, Agent, or Firm*—Peter K. Kontler

[57] ABSTRACT

A method of monitoring filters and sections in a filter tipping machine wherein pairs of coaxial plain cigarettes are united with filter plugs of double unit legnth by adhesive-coated bands. When a filter plug is missing, a mechanical or a photosensitive filter plug detector transmits a signal to a valve which admits compressed air to two nozzles to cause the plain cigarettes which are not separated by a filter plug to move toward each other so that a uniting band which is applied around the adjacent inner end portions of the thus shifted plain cigarettes can adequately connect the plain cigarettes to each other during further transport to a station where the united plain cigarettes can be readily segregated from satisfactory products.

10 Claims, 8 Drawing Figures

SOURCE OF PRESSURIZED FLUID

METHOD OF MONITORING FILTER ROD SECTIONS IN FILTER TIPPING MACHINES

This is a division of application Ser. No. 945,696, filed Sept. 25, 1978, now U.S. Pat. No. 4,238,999.

BACKGROUND OF THE INVENTION

The present invention relates to a method of making filter tipped cigarettes, cigars or cigarillos, and more particularly to a method of monitoring filter rod sections in filter tipping machines. Still more particularly, the invention relates to a method of monitoring filter rod sections (especially filter plugs of double unit length) in filter tipping machines of the type wherein filter tipped smokers' products are produced by placing a rod-shaped filter component of double unit length between a pair of coaxial rod-shaped tobacco-containing components of unit length and by draping an adhesive-coated uniting band around the filter component and the adjacent ends of the tobacco-containing components of unit length. Each filter component of double unit length may contain a filler of one and the same filter material, a composite filler which consists of two or more different filter materials, or each filter component may constitute a so-called recessed filter plug. For the sake of simplicity, the invention will be described with reference to machines for the making of filter tipped cigarettes with the understanding, however, that the improved method can be resorted to with equal advantage in the manufacture of filter tipped cigars or cigarillos.

A modern filter tipping machine turns out large numbers of filter cigarettes per unit of time. Therefore, it is important to insure that the machine can operate without interruptions for extended intervals of time because each and every interruption, even a very short one, entails production losses amounting to thousands of filter cigarettes. Such machines are equipped with means for transporting pairs of coaxial spaced-apart plain cigarettes of unit length along a first path and for feeding filter plugs of double unit length along a second path toward and into the gaps betwen coaxial plain cigarettes of successive pairs. Furthermore, such machines are equipped with devices for forming adhesive-coated uniting bands which are draped around successive filter plugs and the adjacent ends of coaxial plain cigarettes to form tubes which connect the filter plugs with the respective plain cigarettes. The resulting filter cigarettes of double unit length are thereupon severed so that each thereof yields two filter cigarettes of unit length which are tested and some of which are tip-turned so that all filter mouthpieces face in the same direction. The resulting row of filter cigarettes of unit length is thereupon transported to the next processing station, e.g., directly into the magazine of a packing machine. The timing of delivery of pairs of plain cigarettes and filter plugs of double unit length is such that, as a rule, the thus obtained groups of three coaxial rod-shaped articles each form a continuous row moving at a high speed through a draping station, a severing station, one or more testing stations, a tip turning station and toward the outlet of the machine. Provision is made to eliminate all causes of potential malfunction, such as the absence of adhesive-coated uniting bands, the absence of one or more plain cigarettes, improper orientation of rod-shaped components during transport through the filter tipping machine and/or others. Continuing interruptions of the delivery of plain cigarettes, filter plugs and/or uniting bands normally entail immediate stoppage of the machine in order to reduce the number of rejects. However, it happens from time to time that temporary absence of certain components (e.g., filter plugs) is less damaging than even short-lasting stoppage of the filter tipping machine, especially if such machine forms part of a complete production line which further includes one or more cigarette makers, a packing machine, a carton filling machine and/or others. In such situations, it is more economical to maintain the machine in operation for a given interval of time and to accept a certain number of rejects (which are segregated upon testing of the final products) than to arrest the machine and thereby cause losses in output which, within a few minutes, can run into tens of thousands of filter cigarettes. A typical example of the just outlined situation is temporary absence of filter plugs of double unit length. A certain number of filter plugs is likely to fail to reach the assembly station where the filter plugs are inserted between pairs of coaxial plain cigarettes of unit length for a number of reasons, such as temporary failure of the mechanism which transports filter plugs to the assembly station, clogging of one or more flutes in the conveyors which transport filter rod sections of e.g., six times unit length toward and past severing devices which subdivide each relatively long section into filter plugs of double unit length, improper operation of means for retaining the filter plugs in their path during transport toward the assembly station and/or certain other factors.

If a filter plug of double unit length fails to reach the assembly station and the corresponding pair of coaxial plain cigarettes of unit length continues to advance toward the draping station, the uniting band which is applied to such plain cigarettes is likely to become separated therefrom because, as a rule, the band contacts only the innermost portions of wrappers of the plain cigarettes. In the absence of a filter plug in the interior of the convoluted uniting band, the latter is not sufficiently stiff to withstand deforming stresses during further transport of corresponding plain cigarettes through the filter tipping machine. A detached uniting band is likely to adversely affect the operation of the machine, not only because it becomes stuck at a particular point but especially because its adhesive coat contaminates the machine so that the contaminated part or parts interfere with orderly transport of satisfactory groups of coaxial rod-shaped articles through the machine. Sooner or later, one or more improperly applied uniting bands will cause a serious malfunction which is detected, either automatically or by the attendant, and whose elimination necessitates a lengthy interruption of operation of the filter tipping machine or the entire production line.

OBJECTS AND SUMMARY OF THE INVENTION

An object of the invention is to provide a novel and improved method of monitoring the presence or absence of filter plugs in filter tipping machines and of undertaking the necessary steps to avoid stoppage or malfunctioning of the machine on detection of the absence of filter plugs.

Another object of the invention is to provide a method which insures orderly transport of incomplete groups of rod-shaped components in a filter tipping machine all the way to a location where the segregation of such incomplete groups is most convenient and least likely to affect proper transport and/or other manipulation of satisfactory groups.

A further object of the invention is to provide a method which can be practiced, with minor changes, in existing filter tipping machines.

One feature of the invention resides in the provision of a method of producing filter cigarettes or analogous smokers' products wherein one end of a tobacco-containing first rod-shaped component is connected with a coaxial rod-shaped filter component of unit length by an adhesive-coated uniting band which is convoluted around the filter component and the adjacent end of the first component. The method comprises the steps of transporting successive pairs of spaced-apart first components sideways along a first path so that the first components of each pair define a gap having a width which at least equals the length of a filter component of double unit length, transporting a series of filter components of double unit length along a second path and introducing successive filter components of the series into a first portion of the first path so that each filter component enters a gap between a pair of first components (either before or after the first components reach the first portion of the first path), draping discrete adhesive-coated uniting bands around successive filter components of double unit length and the adjacent ends of the respective pairs of first components in a second portion of the first path, monitoring one of the first and second paths ahead of the second portion of the first path for the presence of filter components of double unit length, generating signals in response to detection of absence of filter components of double unit length, and moving the first components of the respective pair (i.e., of that pair which defines an empty gap during travel toward the second portion of the first path) axially toward each other ahead of the second portion of the first path in response to such signals. Thus, when the axially moved first components reach the second portion of the first path, the uniting band which is draped therearound is much more likely to adhere thereto because it contacts relatively large portions of the wrappers of coaxial first components which are not separated by a filter component of double unit length.

The moving step preferably comprises reducing the width of the corresponding gaps to a fraction of the length of a filter component of double unit length (including zero width), preferably to less than one centimeter. Furthermore, the moving step preferably comprises shifting the first components of the respective pairs through identical distances. Such moving step may include directing streams of a pressurized fluid against those ends of the first components which are remote from the respective gap.

The monitoring step may include scanning the first or a third portion of the first path ahead of the second portion with a mechanical sensor. Alternatively, the second or first path can be scanned by optical means, e.g., by a reflexion type photocell or another suitable photosensitive detector.

The method may further comprise the step of moving the first components axially against the respective ends of corresponding filter components of double unit length intermediate the first and second portions of the first path. Such step can be carried out by resorting to suitably configurated cams which flank the path for the pairs of first components and engage those ends of the first components which are remote from the respective filter components of double unit length.

The axially moved pairs of first components are thereupon draped in the same way as the pairs of first components which are separated by filter components of double unit length, and the draped axially moved first components are subsequently removed from the first path, i.e., segregated from articles which consist of three components, namely, of two coaxial first components and a filter component of double unit length therebetween. The draping step preferably comprises rotating successive groups of coaxial components about their respective axes during transport along the second portion of the first path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 7, 8:
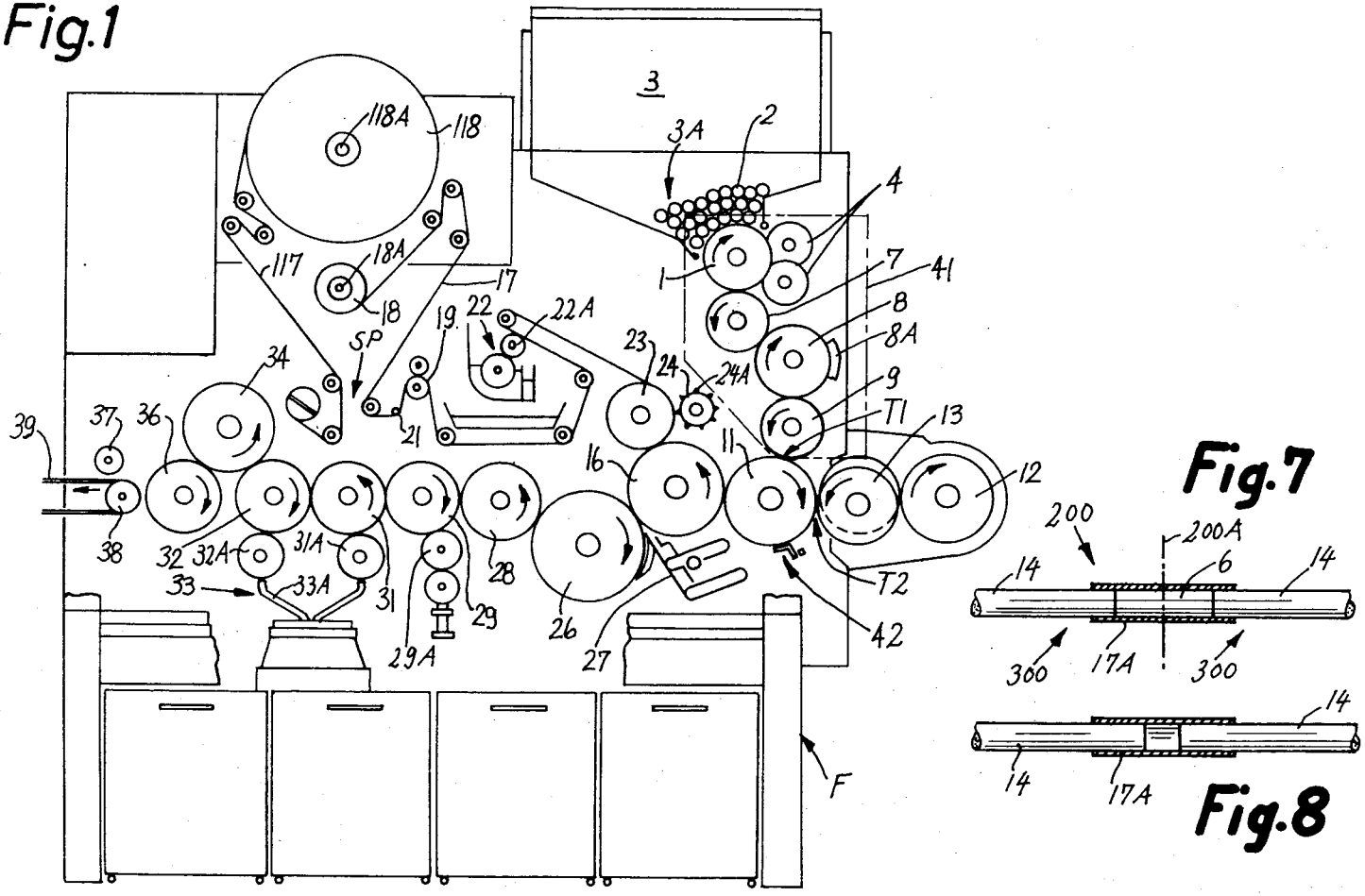
FIG. 1 is a schematic front elevational view of a filter tipping machine for cigarettes including an apparatus which can be used for the practice of a method embodying one form of the invention.
FIG. 7 illustrates a portion of a filter cigarette of double unit length, the convoluted adhesive-coated uniting band being shown in axial section.
FIG. 8 illustrates a portion of a composite rod wherein a uniting band connects two coaxial tobacco-containing components of unit length.

Referring first to FIG. 1, there is shown a filter tipping machine of the type known as "MAX-S" produced by Hauni-Werke Körber & Co. KG., of Hamburg, Federal Republic Germany. The machine comprises a frame F which supports a magazine or hopper 3 for a supply of parallel filter rod sections 2 of multiple unit length, e.g., six times unit length. The magazine 3 has an outlet 3A which receives a portion of a rotary drum-shaped severing conveyor 1 having peripheral flutes (not specifically shown) which remove filter rod sections 2 from the magazine 3 and transport the sections sideways past two rotary disk-shaped knives 4 which subdivide each section 2 into three sections or plugs 6 (see FIGS. 2–4) of two times unit length. The severing conveyor 1 delivers the plugs 6 to three discrete rotary disk-shaped components (only one shown) of a staggering conveyor 7. The components of the staggering conveyor 7 rotate at different speeds and/or transport the respective plugs 6 through different distances so that each group of three originally coaxial plugs 6 is converted into a group wherein the plugs are located one behind the other, as considered in the circumferential direction of the illustrated component of the conveyor 7. The components of the staggering conveyor 7 deliver discrete plugs 6 into successive flutes of a rotary drum-shaped shuffling conveyor 8 which cooperates with stationary cams 8A to form a single row of aligned plugs 6 wherein each preceding plug is in exact alinement with the next-following plug. The shuffling conveyor 8 delivers successive plugs 6 of the thus obtained row into successive flutes of a rotary drum-shaped accelerating conveyor 9 which inserts filter plugs into successive peripheral flutes 11A (see FIG. 3) of a rotary drum-shaped assembly conveyor 11.

The filter tipping machine of FIG. 1 is directly coupled with a cigarette making machine (e.g., a machine known as "GARANT" produced by Hauni-Werke) which comprises a rotary drum-shaped row forming conveyor 12. Each flute of the conveyor 12 contains a single plain cigarette 14 (see FIG. 4) of unit length but the plain cigarettes in evenly numbered flutes of the conveyor 12 are axially offset with respect to the cigarettes 14 in the oddly numbered flutes. Thus, the conveyor 12 delivers two rows of plain cigarettes 14 of unit length, and the distance between the two rows in not less than the length of a filter plug 6 of double unit lenth. The conveyor 12 delivers the two rows of cigarettes 14 to two rotary drum-shaped aligning conveyors 13 which rotate at different speeds and/or transport the respective cigarettes 14 through different distances so that each cigarette 14 which reaches the transfer station between one of the conveyors 13 and the conveyor 11 is in exact axial alignment with the cigarette which reaches, at the same time, the transfer station between the assembly conveyor 11 and the other aligning conveyor 13. In other words, each flute 11A of the assembly conveyor 11 receives a pair of spaced-apart coaxial plain cigarettes 14 of unit length whereby the cigarettes 14 come to rest at the opposite sides of the filter plug 6 in the respective flute 11A. It will be noted that the transfer station (or plug inserting station) T1 between the conveyors 9 and 11 is located ahead of the transfer station T2 between the assembly conveyor 11 and the aligning conveyors 13, i.e., each flute 11A which reaches the station T2 already contains a plug 6.

Each flute 11A which advances beyond the transfer station T2 normally contains a group of three coaxial rod-shaped components, namely, two plain cigarettes (tobacco-containing components) 14 of unit length and a centrally located filter component or plug 6 therebetween. Such groups are thereupon condensed by stationary cams 11B (FIG. 4) which cause (if necessary) the one and/or the other plain cigarette 14 of each pair to move toward the respective plug 6 to thus insure that the inner end faces of the aligned cigarettes 14 abut against the respective end faces of the associated plug 6 before the condensed groups enter the flutes of a rotary drum-shaped transfer conveyor 16.

The frame F of the filter tipping machine further supports a rotary spindle 18A for an expiring reel 18 of wrapping material 17, e.g., a web of cigarette paper, imitation cork or the like. The web 17 is drawn off the reel 18 by two advancing rolls 19 which cause one side of the web 17 to engage the blade of a curling device 21 (preferably a device of the type disclosed in commonly owned U.S. Pat. No. 3,962,957 granted June 15, 1976 to Alfred Hinzmann). The leader of the web 17 adheres to the foraminous peripheral surface of a rotary suction drum 23 which draws the web past a conventional paster 22 serving to coat one side of the web with a suitable adhesive. The suction drum 23 cooperates with a rotary knife 24 whose blades sever the web 17 at regular intervals so that the web yields a succession of discrete adhesive-coated uniting bands 17A (see FIG. 7) each of which is attached to the condensed group in the oncoming flute of the transfer conveyor 16. The manner of attachment is such that a properly applied uniting band 17A extends tangentially of the respective condensed group and its adhesive-coated side is in substantial linear contact with the corresponding filter plug 6 as well as with the inner end portions of the associated plain cigarettes 14 of unit length.

The frame F further supports a second spindle 118A for a fresh reel 118 containing a supply of convoluted wrapping material in the form of a web 117. The leader of the web 117 is held in a position of readiness at a splicing station SP and is automatically attached to the running web 17 shortly or immediately before the supply of web 17 on the expiring reel 18 is exhausted. A splicing device which can be installed at the station SP is disclosed, for example, in commonly owned U.S. Pat. No. 3,730,811 granted May 1, 1973 to Gerd-Joachim Wendt.

The transfer conveyor 16 delivers condensed groups (each of which carries a uniting band 17A) onto the periphery of a rotary drum-shaped wrapping conveyor 26 which cooperates with a stationary or mobile rolling or draping device 27 to rotate each group about its own axis so that the uniting bands 17A are convoluted about the respective plugs 6 and the inner end portions of the corresponding plain cigarettes 14 to form elongated tubes. Each tube sealingly secures the corresponding plug 6 to the aligned plain cigarettes 14 so that each group which advances beyond the rolling device 27 constitutes a filter cigarette 200 of double unit length (see FIG. 7). Rolling or draping devices which can be used in the machine of FIG. 1 are disclosed in commonly owned U.S. Pat. No. 3,527,234 granted Sept. 8, 1970 to Alfred Hinzmann.

The wrapping conveyor 26 delivers successive filter cigarettes 200 of double unit length into successive flutes of a rotary drum-shaped drying conveyor 28 which is heated to promote setting of adhesive on the convoluted uniting bands 17A. The filter cigarettes 200 of double unit length are thereupon transferred into successive flutes of a rotary drum-shaped severing conveyor 29 which cooperates with a rotary disk-shaped knife 29A to sever each filter cigarette 200 of double unit length midway between its ends (see the phantom line 200A in FIG. 7), i.e., each such cigarette yields two coaxial filter cigarettes 300 of unit length. The thus obtained filter cigarettes 300 of unit length form two rows and each pair of coaxial filter cigarettes of unit length enters a discrete flute of a rotary drum-shaped conveyor 31 forming part of a turn-around device 33, preferably of the type disclosed in the commonly owned U.S. Pat. No. 3,583,546 granted June 8, 1971 to Gerhard Koop. The device 33 further comprises a rotary drum-shaped conveyor 31A which accepts one row of cigarettes 300 from the conveyor 31 and delivers the cigarettes of such one row to successive orbiting inverting arms 33A serving to turn each cigarette 300 through 180 degrees and to deliver the inverted cigarettes into successive flutes of a third conveyor 32A forming part of the turn-around device 33. The conveyor 32A delivers inverted cigarettes into alternate flutes of a fourth rotary drum-shaped conveyor 32 of the device 33. The conveyor 32 further receives the other row of cigarettes 300 from the conveyor 31 so that it transports a single row of filter cigarettes of unit length wherein the filter mouthpieces (each such filter mouthpiece constitutes one-half of a filter plug 6) of all cigarettes 300 face in the same direction.

The severing conveyor 29 may form part of a testing device which monitors the quality of filter cigarettes 200 or 300 and effects the segregation of defective articles. The cigarettes 300 of the single row which leaves the conveyor 32 of the turnaround device 33 are transferred onto a further rotary drum-shaped conveyor 34 forming part of a second testing device (such second testing device can serve to monitor the density of the tobacco-containing ends of filter cigarettes 300 of unit length) and cooperates with means for segregating defective filter cigarettes from satisfactory articles. The segregation of defective filter cigarettes 300 of unit length can take place on a further rotary drum-shaped conveyor 36 which receives cigarettes 300 from the flutes of the testing conveyor 34 and delivers satisfactory cigarettes onto the upper reach of a belt conveyor 39 trained over pulleys 38 (only one shown). If desired, the testing on the conveyor 34 can involve monitoring another characteristic of each filter cigarette 300 of unit length, e.g., the permeability of wrappers of the cigarettes or the combined cross-sectional area of perforations which are intentionally formed in the web 17 or in discrete uniting bands 17A to allow a certain amount of atmospheric air to enter the column of tobacco smoke in the lighted article. Reference may be had to commonly owned U.S. Pat. No. 3,483,873 granted Dec. 16, 1969 to Alfred Hinzmann. The testing of tobacco-containing ends of successive filter cigarettes 300 of unit length is then carried out on the conveyor 36.

The illustrated pulley 38 for the belt conveyor 39 cooperates with a rotary braking drum 37 to reduce the speed of filter cigarettes 300 of unit length. The belt conveyor 39 transports satisfactory cigarettes 300 to a further processing station, e.g., to a station where the filter cigarettes are introduced into so-called chargers or trays for transport into storage or to a packing machine, to a pneumatic sender which propels the cigarettes 300 into the magazine of a packing machine, or directly to the magazine of a packing machine.

In the event of a malfunction of the cigarette making machine, the unit 41 which transports filter plugs 6 of double unit length is automatically arrested, e.g., by disengaging a clutch which transmits torque to the conveyors 1, 7, 8 and 9. Reference may be had to commonly owned U.S. Pat. No. 3,212,507 granted Oct. 19, 1965 to Bernhard Schubert. At the same time, the advancing rolls 19 are arrested to interrupt the feed of the uniting band 17 and the latter is disengaged from the roller-shaped applicator 22A of the plaster 22. The filter tipping machine further comprises means (not specifically shown) for monitoring the delivery of filter rod sections 2 in the region below the outlet 3A of the magazine 3. The prime mover for the filter tipping machine is arrested in automatic response to detected absence of sections 2. Such prime mover may be a variable-speed motor which drives the mobile parts of the filter tipping machine as well as the mobile parts of the cigarette making machine. When the cause of malfunction is eliminated, the unit 41 is coupled to the prime mover in a first step and the web 17 is brought into contact with the applicator 22A in the next-following step.

The filter tipping machine is equipped with an apparatus which performs an additional monitoring function and whose primary purpose is to reduce the likelihood of malfunction of the filter tipping machine as a result of the absence of filter plugs 6 in the region of the assembly conveyor 11. Such situation can arise owing to improper operation of the transporting unit 41, i.e., the magazine 3 can be filled with filter rod sections 2 but the conveyor 9 of the unit 41 fails to insert a filter plug 6 into each and every flute 11A of the assembly conveyor 11, or the unit 41 fails to produce filter plugs 6 of satisfactory length. By way of example, and assuming that the filter plugs 6 which are transported by the conveyors 1, 7, 8 and 9 are attracted by suction, one or more suction ports in the peripheral surfaces of these conveyors can be clogged by tobacco dust or by other foreign matter so that one or more filter plugs 6 are permitted to leave the respective conveyor(s) ahead of the transfer station where the plugs 6 are supposed to be transferred onto the next-following conveyor of the transporting unit 41.

The apparatus of FIGS. 1–4 comprises means for monitoring the flutes 11A of the assembly conveyor 11 for the presence or absence of filter plugs 6 downstream of the transfer station T1, preferably downstream of the transfer station T2. The monitoring means of the embodiment which is shown in FIGS. 1 to 4 comprises a sensor here shown as a two-armed bell crank lever 42 which is fulcrumed in the frame F, as at 44, so that it can pivot clockwise and counterclockwise, as viewed in FIG. 1, 2 or 3. The arm 46 of the sensor 42 is biased toward the periphery of the assembly conveyor 11 by a helical spring 59 which is attached to the other arm 43 of the sensor 42 and to a portion of the frame F in a manner not shown in FIGS. 2 and 3. The arm 46 is located centrally between the end faces of the conveyor 11 (see FIG. 4) and has two lateral surfaces 47, 48 which serve as abutments for plain cigarettes 14 in the absence of a plug 6 in the gap 14A between such cigarettes. The arm 46 is preferably thin, i.e., the distance between its lateral surfaces 47, 48 need not exceed a small fraction of one centimeter, e.g., one millimeter.

The surface 49 of the arm 43 of the sensor 42 abuts against a stationary stop 51 when the arm 46 rides over successive filter plugs 6. When the arm 46 detects the absence of a filter plug 6, i.e., an empty gap 14A between two coaxial plain cigarettes 14 in the oncoming flute 11A of the assembly conveyor 11, the spring 59 is free to pivot the sensor 42 clockwise from the position of FIG. 2 to the position of FIG. 3, whereby the surface 49 of the arm 43 moves away from a signal generator 52 here shown as a proximity detector which generates a signal whenever the arm 43 moves away from the stop 51. The detector 52 is preferably provided or associated with a suitable amplifier which amplifies the signals and transmits amplified signals to the solenoid of a normally closed electromagnetic valve 53 installed in a first portion of a conduit 54 which connects a source 54A of pressurized fluid (e.g., an air compressor) with two nozzles 57A, 58A disposed at the discharge ends of two branches 57, 58 communicating with the first portion of the conduit 54 (as at 56) downstream of the valve 53. The orifices of the nozzles 56A, 58A face the outer ends of plain cigarettes 14 in successive flutes 11A of the assembly conveyor 11 in the region of the monitoring station, i.e., at the opposite sides of the arm 46 of the sensor 42. In order to insure that the arm 46 will enter the gap 14A between two oncoming coaxial plain cigarettes 14 without any or with minimal delay, the entire sensor 42 is preferably a lightweight component so that its inertia is negligible. The sensor 42 can be made (at least in part) of light metal or a suitable synthetic plastic material. All that counts is to insure that the arm 46 immediately penetrates into an empty gap 14A between two oncoming plain cigarettes 14 (i.e., that the sensor detects the absence of a plug 6 in the flute 11A) and that the arm 43 can cause the detector 52 to furnish an appropriate signal whenever the sensor 42 is caused to move to the position of FIG. 3.

Figures 2, 3, 4, 5, 6:
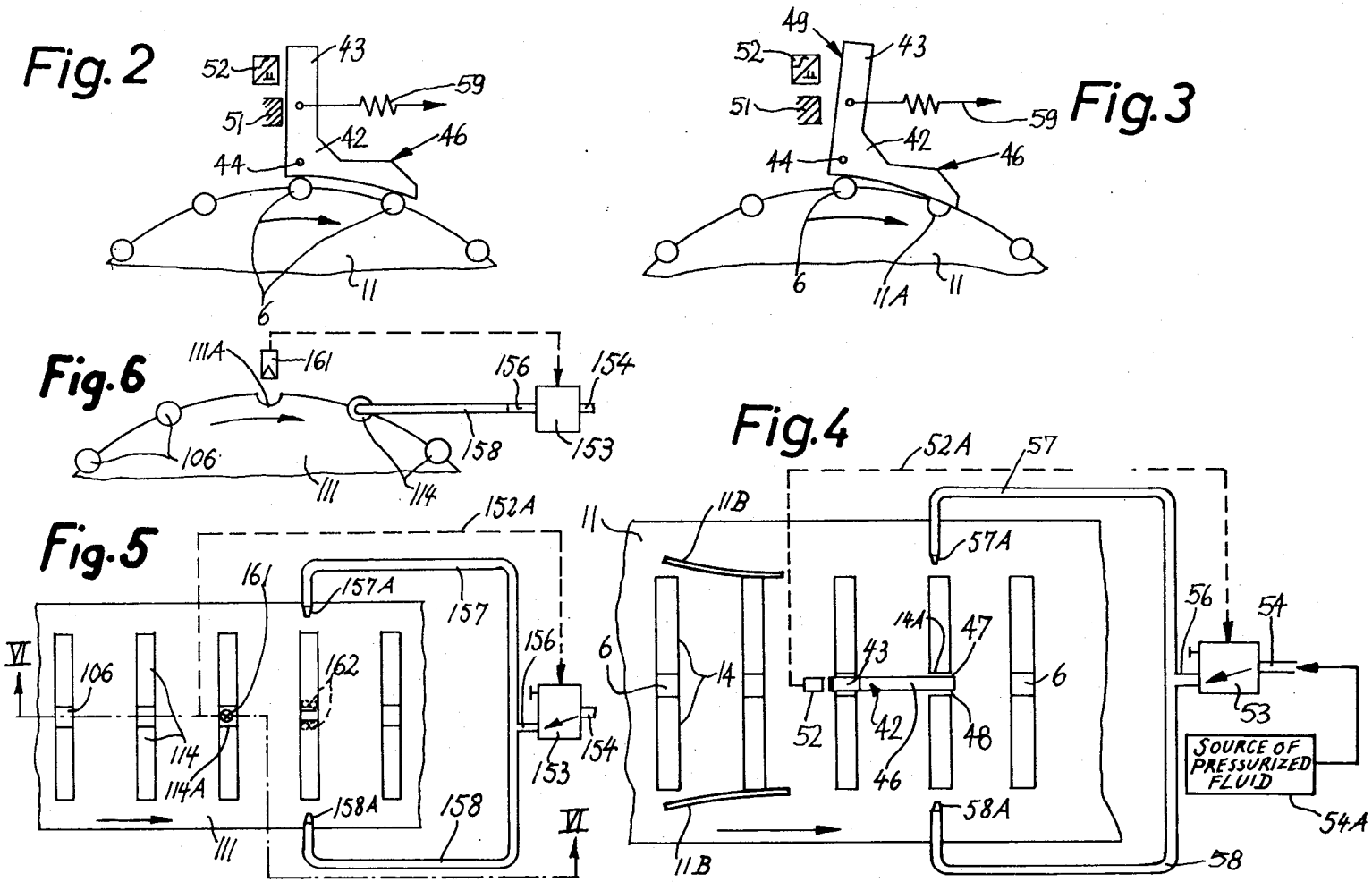
FIG. 2 is an enlarged view of a detail in FIG. 1, showing a mechanical sensor which monitors the path for rod-shaped components to detect the presence or absence of filter components of double unit length, the sensor being shown in a position it assumes when it detects the presence of a filter component.
FIG. 3 illustrates the structure of FIG. 2, with the sensor in a different position which it assumes upon detection of the absence of a filter component of double unit length.
FIG. 4 is a plan view of the structure of FIG. 3, further showing the means for moving pairs of coaxial tobacco-containing components toward each other in response to detection of the absence of filter components between such tobacco-containing components.
FIG. 5 is a plan view of a modified apparatus which employs an opto-electrical detector for filter components of double unit length.
FIG. 6 is a sectional view as seen in the direction of arrows from the line VI—VI of FIG. 5.

As shown in FIG. 4, the pairs of coaxial plain cigarettes 14 are delivered to the assembly conveyor 11 in such a way that they are mirror symmetrical to each other with reference to the plane including the arm 46 of the sensor 42. Thus, when a plug 6 is missing, the arm 46 penetrates into the gap 14A midway between the inner ends of cigarettes 14 in that flute 11A which does not contain a plug 6.

FIG. 2 shows the sensor 42 in that angular position which the sensor assumes when its arm 46 contacts a filter plug 6. The surface 49 of the arm 43 is then closely adjacent to or abuts against the stop 51 and the spring 59 stores energy. The detector 52 is inoperative, i.e., the conductor means 52A (shown in FIG. 4 by broken lines) does not energize the solenoid of the valve 53 and the branches 57, 58 of the conduit 54 are sealed from the source 54A.

When a filter plug 6 is missing, the spring 59 pivots the sensor 42 to the position of FIG. 3 whereby the arm 46 enters the gap 14A between the plain cigarettes 14 in the oncoming flute 11A of the assembly conveyor 11. This causes the detector 52 to transmit a signal via conductor means 52A whereby the valve 53 opens for a short interval of time and allows pressurized fluid (preferably compressed air) to flow toward and through the orifices of the nozzles 57A, 58A which abruptly propel the cigarettes 14 against the respective lateral surface 47, 48 of the arm 46. Thus, the width of the gap 14A is reduced to a fraction of the length of a plug 6, namely the width of the narrowed gap equals the distance between the surfaces 47, 48 (as mentioned above, such distance can be in the range of one millimeter). Since the arm 46 is located midway between the inner end faces of oncoming pairs of cigarettes 14, each cigarette is shifted to the same extent whenever the nozzles 57A, 58A receive streams of pressurized fluid. Therefore the composite rod (FIG. 8) including two coaxial plain cigarettes 14 which advances beyond the arm 46 has a length which only slightly exceeds the combined length of two plain cigarettes 14. Furthermore, and since the gap between the cigarettes 14 of such composite rod is very narrow, the rod can properly receive and hold an adhesive-coated uniting band 17A which is applied thereto on the transfer conveyor 16. Also, the uniting band 17A is properly convoluted around the composite rod during travel with the wrapping conveyor 26. Still further, and if the conveyor 29 does not form part of a testing device, the two halves of the composite rod which are obtained during travel with the severing conveyor 29 (past the rotary knife 29A) are segregated from filter cigarettes 300 of unit length during travel with one of the next-following conveyors, e.g., during travel in the flutes of the conveyor 34 or 36. At any rate, defective articles which are obtained by convoluting an adhesive-coated uniting band 17A around two cigarettes 14 which are not separated from each other by a filter plug 6 are not permitted to reach the belt conveyor 39. On the other hand, the provision of the aforedescribed apparatus including the sensor 42, detector 52 and valve 53 insures that each and every uniting band 17A is properly applied, either to a satisfactory group including two plain cigarettes 14 and a filter plug 6 therebetween or to a composite rod consisting of two coaxial plain cigarettes 14 with a narrow gap between such plain cigarettes. In the absence of the aforedescribed apparatus, the uniting bands 17A which would not meet a filter plug 6 during transfer to rod-shaped articles at the periphery of the conveyor 16 would be likely to become detached from the inner end portions of corresponding plain cigarettes 14 and to adhere to adjacent parts of the filter tipping machine. This would interfere with orderly progress of satisfactory groups and/or filter cigarettes 200 or 300 of double unit length or unit length and would necessitate temporary stoppage of the entire machine together with one or more other machines of the production line which includes the filter tipping machine. Even short-lasting stoppage of the production line can entail substantial losses in output since a modern cigarette maker turns out at least 4000 plain cigarettes per minute. The apparatus reduced the likelihood of contamination of the filter tipping machine by loose adhesive-coated uniting bands by the simple expedient of reducing the width of gaps 14A between plain cigarettes 14 which are not separated by filter plugs 6 to such an extent that an adhesive-coated uniting band 17A will properly adhere to two plain cigarettes even if there is no filter plug in the corresponding flute of the transfer conveyor 16. Satisfactory adherence of uniting bands 17A to both cigarettes 14 of a composite rod is insured due to the fact that both plain cigarettes move toward the arm 46 when the nozzles 57A, 58A discharge pressurized fluid, i.e., the inner end portions of such cigarettes move sufficiently close to each other to insure that a uniting band which is attached thereto by the suction drum 23 will adhere to the cigarettes during transport through the rolling gap between the wrapping conveyor 26 and the rolling or draping device 27.

As a rule, the articles which are obtained by connecting two coaxial plain cigarettes 14 to each other without a filter plug 6 therebetween are transported to a device which opens up their wrappers and recovers the tobacco shreds for reintroduction into the cigarette making machine. A suitable device for recovery of tobacco shreds from defective cigarettes is disclosed in commonly owned U.S. Pat. No. 3,255,762 granted June 14, 1966 to Anton Baier.

FIGS. 5 and 6 illustrate a modified apparatus wherein all such parts which are identical with or clearly analogous to corresponding parts of the apparatus of FIGS. 2–4 are denoted by similar reference characters plus 100. The mechanical sensor 42 of FIGS. 2–4 is replaced with an opto-electrical sensor in the form of a photocell 161 which is closely adjacent to the periphery of the drum-shaped assembly conveyor 111 and transmits electric signals in response to detection of absence of filter plugs 106. Such signals are transmitted via conductor means 152A to the solenoid of the valve 153 which opens to admit pressurized fluid to the orifices of the nozzles 157A, 158A. The jets of fluid which issue from such orifices can move the respective plain cigarettes 114 into actual abutment with each other, i.e., the gaps 114A can disappear altogether. Alternatively, and as shown in FIG. 5, the flutes 111A of the assembly conveyor 111 can be formed with suction ports 162 which serve to attract filter plugs 106 of double unit length. In the absence of a filter plug, the corresponding suction ports 162 serve to attract the inner end portions of cigarettes 114 so that the width of gaps 114A need not be reduced to zero. The manner in which suction ports can be used to arrest axial movements of rod-shaped articles is disclosed, for example, in commonly owned U.S. Pat. No. 3,602,357 granted Aug. 31, 1971 to Bernhard Schubert and to commonly owned U.S. Pat. No. 3,535,003 granted Oct. 20, 1970 to Willy Rudszinat et al. In each instance, the composite rod which is obtained on movement of two coaxial plain cigarettes 114 toward each other has two halves which are mirror symmetrical to each other with reference to the central symmetry plane of the assembly conveyor 111. Such plane is normally located midway between the axial ends of the conveyor 111.

FIG. 7 shows a portion of a filter cigarette 200 of double unit length. This cigarette comprises two plain cigarettes (e.g., 14) of unit length and a filter plug (e.g., 6) of double unit length between the plain cigarettes. The adhesive-coated uniting band 17A is convoluted to form a tube which adheres to the entire external surface of the plug 6 and to the inner end portions of wrappers of the plain cigarettes 14.

FIG. 8 illustrates a portion of a composite rod which consists of two plain cigarettes (e.g., 14) separated from each other by a gap (whose width is exaggerated for the sake of clarity) having a width which is a small fraction of the width of a gap 14A, i.e., a small fraction of the length of a filter plug 6. It will be noted that the convoluted uniting band 17A adheres to relatively large portions of the wrappers of the cigarettes 14 so that the composite rod of FIG. 8 constitutes a self-supporting body which can be readily transported through certain parts of the filter tipping machine, substantially in the same way as a filter cigarette 200 of double unit length. In other words, the presence of a narrow clearance between the plain cigarettes 14 of FIG. 8 does not unduly reduce the stiffness of the composite rod and the convoluted uniting band 17A is highly unlikely to become separated from the plain cigarettes 14 during transport through that portion of the machine which extends between the transfer conveyor 16 and the locus of segregation of the composite rod of FIG. 8 (prior to or after severing) from the machine. FIG. 8 further shows that the axial length of the convoluted uniting band portion which surrounds the left-hand plain cigarette 14 is identical with the axial length of the convoluted uniting band portion which surrounds the right-hand plain cigarette 14. This is due to the fact that the arm 46 of the sensor 42 is preferably located in a plane which halves a freshly formed uniting band on the suction drum 23, i.e., that each band which is applied to two axially shifted plain cigarettes surrounds identical lengths of the wrappers of both plain cigarettes.

The composite rod of FIG. 8 is preferably ejected at a station of the filter tipping machine wherein the filter cigarettes 200 of double unit length are supported close to their ends, i.e., the shorter composite rods are not supported during travel through such station and can descend into a suitable collecting receptacle, not shown, for delivery to the mechanism which recovers the tobacco shreds. However, it is equally possible to provide a discrete monitoring device which ascertains the length of each rod-shaped article that advances beyond the rolling device 27 and effects ejection of shorter articles, i.e., of composite rods of the type shown in FIG. 8.

It is further within the purview of the invention to employ other types of monitoring means for filter plugs 6 or 106. Thus, instead of resorting to mechanical sensors (42) or optical sensors (161), the apparatus can employ electronic sensors which are designed to generate or effect the generation of appropriate signals on detection of the absence of filter plugs 6 or 106. The mechanical sensor 42 of FIGS. 2–4 is relatively simple and reliable. Moreover, the helical spring 59 or an analogous biasing means insures that the arm 46 of the sensor 42 invariably enters an oncoming empty gap 14A even if the assembly conveyor 11 is driven at a high speed. The photosensitive detector 161 of FIGS. 5 and 6 exhibits the advantage that it does not comprise any moving parts and that the sensor and the signal generating means can form a unitary assembly.

The placing of the sensor 42 or detector 161 substantially midway between the axial ends of the assembly conveyor 11 or 111 insures that the plain cigarettes 14 or 114 which are not separated by a filter plug 6 or 106 are properly oriented with respect to the corresponding uniting band during travel past the suction drum 23 even if the uniting band is shifted (to a certain extent) from an optimum position. In other words, such positioning of the monitoring means, combined with a pronounced reduction of the width of an empty gap 14A or 114A during travel between the nozzles 57A, 58A or 157A, 158A, insures that an adhesive-coated uniting band can properly couple two axially shifted plain cigarettes 14 or 114 even if the length of the uniting band portion which adheres to one of the plain cigarettes exceeds the length of the uniting band portion which adheres to the other plain cigarette.

Finally, it is equally within the purview of the invention to place the monitoring means adjacent to that (second) path which is defined by the conveyors 1, 7, 8 and 9 and to provide a suitable time delay device for signals which are generated on detection of the absence of a filter plug 6 or 106 so that such signals cause the valve 53 or 153 to open at an appropriate time, i.e., when the pair of plain cigarettes 14 or 114 which do not flank a filter plug 6 or 106 travels in a predetermined portion of the first path. For example, the plain cigarettes which are not to be assembled with a filter plug of double unit length can be moved axially toward each other on the conveyor 12, on the conveyors 13, on the assembly conveyor 11 or on the transfer conveyor 16, as long as they are moved axially toward each other ahead of that portion (transfer station between the suction drum 23 and the conveyor 16) of the first path (namely of the path for pairs of plain cigarettes) where the groups of rod-shaped components are contacted by adhesive-coated uniting bands.

U.S. Pat. No. 3,699,974 granted Oct. 24, 1972 to Powell et al. discloses a filter tipping machine wherein two nozzles (shown at 84 in FIG. 4) serve to move coaxial plain cigarettes toward each other immediately ahead of the station where groups normally consisting of two plain cigarettes and a filter plug are connected with uniting bands. The purpose of the nozzles is to insure that two plain cigarettes without a filter plug therebetween (but connected to each other by an adhesive-coated uniting band) are ejected immediately downstream of the station where the uniting bands are converted into tubes. The absence of filter plugs is intentional because the patented apparatus monitors the cigarette paper web and interrupts the delivery of a filter plug when it detects a splice in the web.

Moreover, the patented apparatus does not embody monitoring means for filter plugs and does not insure that the plain cigarettes which are moved toward each other during travel between the nozzles are centered with respect to groups which contain two plain cigarettes and a filter plug. Therefore, and since the extent to which the plain cigarettes are shifted by jets of compressed air issuing from the nozzles of the patented apparatus depends on a host of unpredictable parameters (such as friction, unequal pressure of air in the two nozzles, the weight of plain cigarettes and/or others), the patented apparatus cannot insure automatic ejection of all composite rods which do not have filter plugs. If the plain cigarettes which have advanced beyond the nozzles are not properly centered, the uniting band is likely to adhere to one of the cigarettes only so that the band does not unite the cigarettes and allows them to contaminate the machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a method of producing filter cigarettes or analogous smokers' products wherein one end of a tobacco-containing first rod-shaped component is connected with a coaxial rod-shaped filter component by an adhesive-coated uniting band which is convoluted around the filter component and the adjacent end of the first component, the steps of transporting successive pairs of spaced-apart first components sideways along a first path so that the first components of each pair define a gap having a width at least equal to the length of a filter component of double unit length; transporting a series of discrete filter components of double unit length along a second path and introducing successive filter components of said series into a first portion of said first path so that each filter component is located in the gap between a pair of first components; draping discrete adhesive-coated uniting bands around successive filter components of double unit length and the adjacent ends of the first components of the respective pairs in a second portion of said first path; monitoring said second path ahead of said second portion of said first path for the presence of filter components of double unit length; generating signals in response to detection of the absence of filter components of double unit length; and moving the first components of the respective pairs axially toward each other in response to said signals ahead of said second portion of said first path.

2. The steps of claim 1, wherein said moving step comprises reducing the width of the corresponding gaps to a fraction of the length of a filter component of double unit length.

3. The steps of claim 1, wherein said moving step comprises shifting the corresponding first components through identical distances.

4. The steps of claim 1, wherein said moving step includes directing streams of a pressurized fluid against those ends of first components which are remote from the respective gap.

5. The steps of claim 1, wherein said monitoring step includes scanning said one path with a mechanical sensor.

6. The steps of claim 1, wherein said monitoring step includes optically scanning said one path.

7. The steps of claim 1, and the additional steps of moving successive coaxial first components axially against the respective filter components in a further portion of said first path ahead of said second portion.

8. The steps of claim 1, and the additional steps of draping uniting bands to axially moved pairs of first components in said second portion of said first path, and removing such axially moved coaxial first components from said first path downstream of said second portion.

9. The steps of claim 8, wherein each of said draping steps comprises rotating successive groups of coaxial components about their respective axes during transport along said second portion of said first path.

10. In a method of producing filter cigarettes or analogous smokers' products wherein one end of a tobacco-containing first rod-shaped component is connected with a coaxial rod-shaped filter component by an adhesive-coated uniting band which is convoluted around the filter component and the adjacent end of the first component, the steps of transporting successive pairs of spaced-apart first components sideways along a first path so that the first components of each pair define a gap having a width at least equal to the length of a filter component of double unit length; transporting a series of discrete filter components of double unit length along a second path and introducing successive filter components of said series into a first portion of said first path so that each filter component is located in the gap between a pair of first components; draping discrete adhesive-coated uniting bands around successive filter components of double unit length and the adjacent ends of the first components of the respective pairs in a second portion of said first path; monitoring one of said paths ahead of said second portion of said first path for the presence of filter components of double unit length; generating signals in response to detection of the absence of filter components of double unit length; and moving at least one of the first components of the respective pairs axially toward the other in response to said signals and ahead of said second portion of said first path.

* * * * *